United States Patent [19]

Steinman

[11] Patent Number: 4,595,627

[45] Date of Patent: Jun. 17, 1986

[54] FLUORESCENT TEXTILE MATERIAL

[75] Inventor: Barry Steinman, Stamford, Conn.

[73] Assignee: Safety Trim Industries, Inc., New York, N.Y.

[21] Appl. No.: 698,679

[22] Filed: Feb. 6, 1985

[51] Int. Cl.[4] ..... B32B 5/16

[52] U.S. Cl. ..... 428/241; 156/148; 156/264; 156/265; 428/257; 428/258; 428/406; 428/407

[58] Field of Search ..... 139/420 C, 420 R; 156/148, 264, 265, 244.10; 28/166; 428/406, 241, 407, 257, 258

[56] References Cited

U.S. PATENT DOCUMENTS 3,790,431 2/1974 Tung ..... 428/241
4,082,427 4/1978 Nakashimo ..... 428/241

FOREIGN PATENT DOCUMENTS 220975 4/1959 Australia ..... 428/241

*Primary Examiner*—James J. Bell
*Attorney, Agent, or Firm*—Charles E. Temko

[57] ABSTRACT

An improved fluorescent textile material at least partially made from filaments formed from glass-beaded coated sheet stock which is laminated back-to-back, slitted and woven to form a fluorescent greig good material which may be subsequently dyed to desired color or colors.

4 Claims, 4 Drawing Figures

FLUORESCENT TEXTILE MATERIAL

BACKGROUND OF THE INVENTION

This invention relates generally to the field of clothing, and more particularly to an improved woven textile fabric material incorporating light-reflective surfaces whereby upon incorporation into a garment, the garment provides a measure of safety to the wearer when walking, jogging or cycling after daylight hours.

Reflective fabrics are known in the art, the most common type being that in which tiny glass beads are incorporated into a flexible resin in planar sheet form and applied to an exposed surface of the garment. A widely distributed product embodying this construction is currently marketed by Minnesota Manufacturing and Mining Company (3M) under the trademark SCOTCH-LITE. Such fabric is normally available with a heat and pressure type adhesive by means of which it may be attached to a textile surface of a fabric. In other forms, the beads are applied in a synthetic resin binder directly to this textile fabric.

It is also known in the art to fabricate entire garments of such materials for police and other emergency use. Such garments are, of course, not suitable for general wear, and are not sufficiently attractive for every day use.

One of the principal problems arising from the use of reflective materials of this type lies in the fact that they are non-woven, and thus tend to make the garment rather gaudy in appearance. In the past, attempts to manufacture a thread or filament which will retain reflective properties have failed for the reason that coating the thread or filament of circular cross-section tends to reduce the effective amount of reflective material which is exposed in the finished textile material. The reflective surface also tends to abraid with use and laundering of the garment to further reduce the available reflective qualities. Another disadvantage of this construction lies in the marketing aspects of the material. Where the reflective material is bonded to the textile material, the textile material must be completely finished prior to this application, and cannot be manufactured as greig goods. When a finished textile fabric is coated using a glass bead impregnated coating, difficulty has been encountered in developing a coating which will continuously adhere to the textile fabric after application, and the above-mentioned gaudy appearance cannot be avoided.

SUMMARY OF THE INVENTION

Briefly stated, the invention contemplates the provision of an improved manufacturing process and resulting textile product, in which reflective properties may be incorporated in an attractive manner such that the reflective areas are not readily apparent to a viewer under normal lighting conditions. The process includes the laminating of a pair of sheets of known reflective sheet material using a synthetic resinous bond. The laminate which then has a reflective coating on each opposite surface, is then slitted into filaments of generally square cross-section, approximately 0.015 inches on each side, and the filaments are then used as warp or weft threads in the weaving of textile material which includes other non-reflective threads of either natural or synthetic resinous origin. Preferably, the reflective filaments are employed as adjacent picks in selected areas which comprise less than the entire surface of the finished good. The reflective threads will appear as small segments of individual threads interspersed between similar non-reflective segments, so that upon viewing the finished material, the presence of reflective areas is not readily apparent. Depending upon the nature of the nonreflective threads which are used, the finished good may be dyed to desired color or colors using techniques known in the art.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
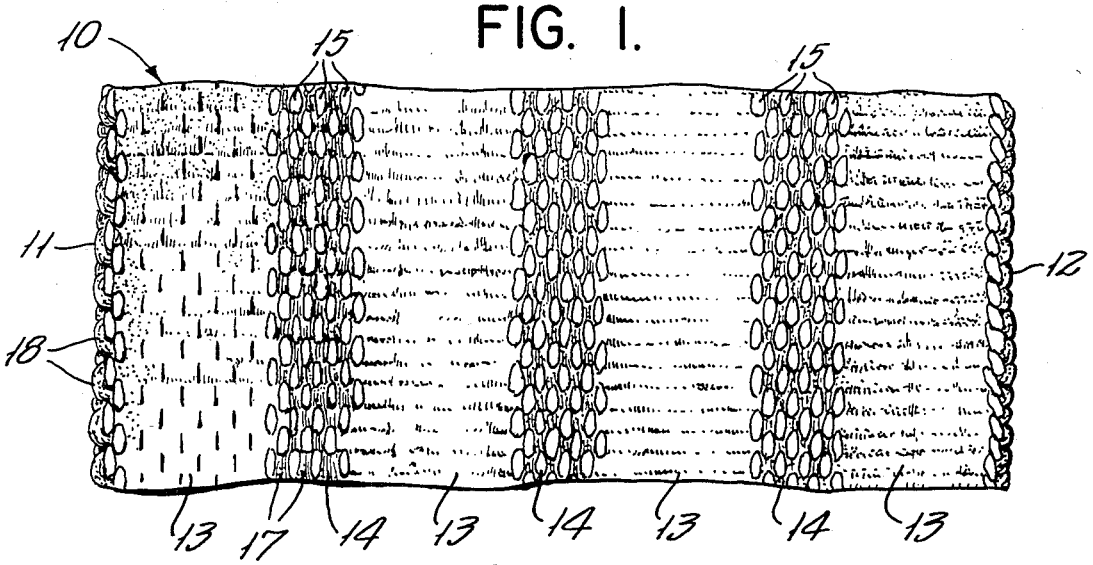
FIG. 1 is a front elevational view of a strip of woven fabric formed in accordance with the present invention.

In accordance with the invention, reference character 10 designates a finished strip of material manufactured in accordance with the disclosed invention. It will be understood by those skilled in the art that the invention is not limited to the manufacture of relatively narrow strips which can be used as slide fastener tapes, and the like, or for edge binding. Where desired, the disclosed method may be employed to manufacture textile material of wider standard and non-standard widths.

The strip 10 is bounded by side edges 11 and 12, and includes a plurality of non-reflective areas 13 as well as a plurality of reflective areas 14. The reflective areas 14 include both reflective warp threads 15 and non-reflective warp threads 17. The weft threads 18 are preferably non-reflective. It will be understood that where greater reflective properties are required, it is possible to use all reflective warp threads in the reflective areas 14 in the juxtaposed picks, rather than as adjacent picks illustrated in FIG. 1. By interspersing the reflective threads with non-reflective threads, a softer more attractive appearance is obtained in which the reflective qualities are not readily apparent during the daylight hours.

Figure 2:
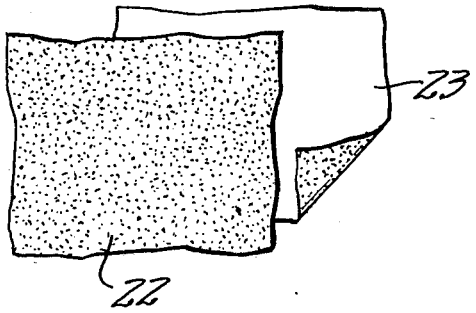
FIG. 2 is an exploded view showing a pair of coated synthetic resinous sheets, each having a reflective surface prior to bonding the same together as a first step in the disclosed method of fabrication.
Figure 3:
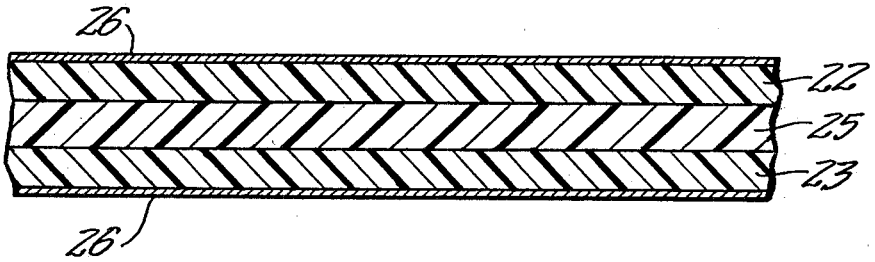
FIG. 3 is a side elevational view of the bonded sheets.
Figure 4:
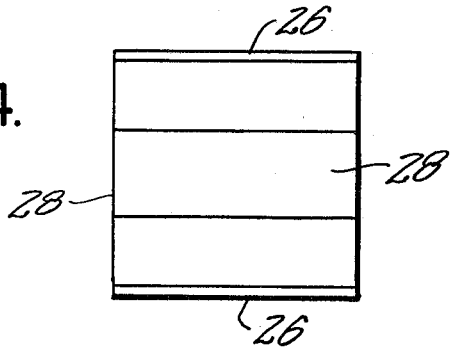
FIG. 4 is an end elevational view of a single reflective filament obtained by multiple slitting of the article shown in FIG. 3.

FIGS. 2, 3, and 4 illustrates steps in the production of the reflective threads. In FIG. 2, there is first provided first and second sheets 22 and 23 which are formed by coating only a single surface thereof with a known glass-beaded reflective coating. A single sheet is formed by bonding the non-reflective surfaces of each of the sheets together, which may be conveniently accomplished by providing a bonding sheet 25 of mylar or polyester, using techniques known in the art. Most conveniently, the bonded sheet has a thickness of approximately 0.015 inches although greater or lesser thicknesses are also suitable, depending upon the quality of the finished piece good desired.

FIG. 4 illustrates a cross-section of a single filament which results from slitting the single sheet shown in FIG. 3 into narrow strips approximately 0.015 inches wide and 0.015 inches thick. The resulting filament or "thread" will include oppositely disposed coated surfaces 26 and side surfaces 28 which are free of coating.

During the weaving process, the normal amount of tension applied to the warp thread will maintain the filaments in proper orientations so that when woven, the reflectively coated surfaces will be exposed in the finished piece good during the weaving process. The reflective filaments are combined with non-reflective filaments or threads of either natural or synthetic resinous origin, and where the reflective filaments comprise a relatively small percentage of the entire number of threads or filaments employed, the resulting product does not exhibit the usual objectionable shine or gloss common to prior art reflective garments. As has been mentioned, it is possible to incorporate the reflective filaments into a greig good product, which may be subsequently dyed to order without affecting the reflective properties of the finished good.

What is claimed is:

1. As new article of manufacture a woven piece good consisting of warp and weft threads, at least some of said warp and weft threads being monofilaments of substantially square cross-section, and having at least two oppositely disposed glass-beaded reflective surfaces, further characterized in said filaments being formed by slitting a pair of bonded oppositely facing synthetic resinous sheets having a glass-beaded reflective coating on the then exposed surfaces thereof.

2. The method of making a synthetic resinous reflective filament for weaving comprising the steps of:

(a) Providing a pair of planar synthetic sheets each having a first surface coated with a glass-beaded reflective coating, and a second surface which is free of reflective coating;

(b) Bonding said first and second sheets together over the second surfaces thereof to form a single sheet of material; and (c) Slitting said single sheet into filaments of substantially square cross-sections having a pair of oppositely disposed reflective surfaces.

3. The method of manufacturing a piece good having light reflective properties comprising the steps of:

(a) Providing a pair of planar synthetic sheets each having a first surface coated with a glass-beaded reflective coating, and a second surface which is free of reflective coating;

(b) Bonding said first and second sheets together over the second surfaces thereof to form a single sheet of material;

(c) Slitting said single sheet into filaments of substantially square cross-sections having a pair of oppositely disposed reflective surfaces, and (d) Using said reflective filaments together with other non-reflective filaments to weave said piece good such that said reflective filaments form adjacent picks over less than the entire area of said piece good.

4. The method in accordance with claim 3, in which said reflective filaments are approximately 0.015 inches in width.

* * * * *

REEXAMINATION CERTIFICATE (1211th)

United States Patent [19] [11] B1 4,595,627

Steinman [45] Certificate Issued Feb. 27, 1990

[54] FLUORESCENT TEXTILE MATERIAL

[75] Inventor: Barry Steinman, Stamford, Conn.

[73] Assignee: Safety Trim Industries, Inc.

Reexamination Request:
No. 90/001,304, Aug. 17, 1987

Reexamination Certificate for:

| | |
|---|---|
| Patent No.: | **4,595,627** |
| Issued: | **Jun. 17, 1986** |
| Appl. No.: | **698,679** |
| Filed: | **Feb. 6, 1985** |

[51] Int. Cl.[4] ..... B32B 5/16

[52] U.S. Cl. ..... 428/241; 156/148; 156/264; 156/265; 428/257; 428/258; 428/406; 428/407

[58] Field of Search ..... 428/241, 257, 258, 406, 428/407; 28/166; 139/402 R, 420 C; 156/148, 264, 265, 244.10

*Primary Examiner*—James J. Bell

[57] ABSTRACT

An improved fluorescent textile material at least partially made from filaments formed from glass-beaded coated sheet stock which is laminated back-to-back, slitted and woven to form a fluorescent greig good material which may be subsequently dyed to desired color or colors.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *